US011293443B2

(12) United States Patent
Lawyer et al.

(10) Patent No.: US 11,293,443 B2
(45) Date of Patent: Apr. 5, 2022

(54) PUMP AND PUMP ASSEMBLY

(71) Applicant: EcoTech Marine, LLC, Allentown, PA (US)

(72) Inventors: Justin Lawyer, Bethlehem, PA (US); Patrick Clasen, Allentown, PA (US); Timothy Marks, Northampton, PA (US)

(73) Assignee: EcoTech, LLC, Bethlehem, PA (US)

( * ) Notice: Subject to any disclaimer, the term of this patent is extended or adjusted under 35 U.S.C. 154(b) by 0 days.

(21) Appl. No.: 16/730,387

(22) Filed: Dec. 30, 2019

(65) Prior Publication Data

US 2020/0132075 A1 Apr. 30, 2020

Related U.S. Application Data

(63) Continuation of application No. 15/359,792, filed on Nov. 23, 2016, now Pat. No. 10,519,956, which is a continuation of application No. 13/215,675, filed on Aug. 23, 2011, now abandoned.

(60) Provisional application No. 61/375,961, filed on Aug. 23, 2010.

(51) Int. Cl.

| | |
|---|---|
| ***F04D 13/02*** | (2006.01) |
| ***F04D 29/58*** | (2006.01) |
| ***F04D 13/06*** | (2006.01) |
| ***F04D 29/22*** | (2006.01) |
| ***F04D 29/42*** | (2006.01) |
| ***F04D 29/44*** | (2006.01) |

(52) U.S. Cl.

CPC ..... *F04D 13/024* (2013.01); *F04D 13/06* (2013.01); *F04D 29/22* (2013.01); *F04D 29/426* (2013.01); *F04D 29/445* (2013.01); *F04D 29/5806* (2013.01); *F04D 29/588* (2013.01)

(58) Field of Classification Search

CPC .... F04D 13/024; F04D 13/06; F04D 29/5806; F04D 29/588; F04D 29/5893; F04D 29/406; F04D 29/22; F04D 29/426; F04D 29/445

See application file for complete search history.

(56) References Cited

U.S. PATENT DOCUMENTS

| | | | | |
|---|---|---|---|---|
| 1,484,962 A * | 2/1924 | Randle | H02K 9/06 310/60 R |
| 1,551,236 A * | 8/1925 | Carter | H02K 9/06 310/62 |
| 2,321,126 A * | 6/1943 | Breuer | F04D 25/082 417/367 |
| 2,488,945 A | 11/1949 | Troller | |
| 2,970,548 A * | 2/1961 | Berner | F04D 13/027 417/420 |

(Continued)

FOREIGN PATENT DOCUMENTS

| | | |
|---|---|---|
| DE | 4330648 A1 | 3/1995 |
| WO | WO2009143570 | 5/2009 |

*Primary Examiner* — Christopher S Bobish

(74) *Attorney, Agent, or Firm* — Berenato & White, LLC

(57) ABSTRACT

Provided is a fluid pump assembly. The pump has a pair of housings magnetically coupled to each other. The first housing contains a drive motor and a magnetic assembly. The second housing contains a magnetic assembly and a blade for imparting movement to a fluid. As the first magnetic assembly is rotated by the drive motor, the magnetic connection to the assembly in the second housing causes the second magnet to rotate, driving the blade.

10 Claims, 12 Drawing Sheets

(56) References Cited

U.S. PATENT DOCUMENTS 2,996,994 A * 8/1961 Wright ..... F04D 13/027 417/420
3,114,323 A * 12/1963 Moser ..... H02K 5/12 417/423.12
3,321,081 A * 5/1967 Willinger ..... A01K 63/04 210/167.25
3,481,586 A 12/1969 Roberts
3,512,646 A * 5/1970 Willinger ..... F04D 13/026 210/167.21
3,649,137 A * 3/1972 Laing ..... F04D 13/027 417/420
3,710,156 A 1/1973 Laing
4,024,064 A * 5/1977 Rakowicz ..... A01K 63/04 210/258
4,283,645 A * 8/1981 Hofmann ..... A01K 63/047 310/87
4,304,532 A 12/1981 McCoy
4,526,518 A * 7/1985 Wiernicki ..... F04C 15/0069 417/420
4,589,822 A * 5/1986 Clausen ..... F04D 29/126 277/397
4,742,257 A * 5/1988 Carpenter ..... H02K 9/14 310/57
4,982,461 A * 1/1991 Mikiya ..... A61H 33/6063 4/541.3
5,127,796 A * 7/1992 Nakao ..... H02K 49/108 417/420
5,215,501 A * 6/1993 Ushikoshi ..... F04C 29/0064 415/10
5,676,526 A 10/1997 Kuwana et al.
5,690,519 A * 11/1997 Chen ..... B63H 23/22 417/420
5,789,833 A * 8/1998 Kinoshita ..... H02K 9/08 310/64
5,877,576 A * 3/1999 CoChimin ..... B22C 9/046 310/418
5,915,931 A * 6/1999 Lindner ..... H02K 49/106 417/420
6,048,363 A * 4/2000 Nagyszalanczy ... A61M 1/1086 623/3.13
6,302,661 B1 10/2001 Khanwilkar
6,551,078 B2 4/2003 Huang
6,700,237 B1 * 3/2004 Yang ..... H02K 9/10 165/47
6,774,514 B2 * 8/2004 Matsuoka ..... H02K 5/1732 310/52
6,988,290 B2 1/2006 Enoch, III
7,249,571 B2 7/2007 Allis
7,313,840 B2 1/2008 Watkins
7,347,674 B2 * 3/2008 Terry ..... H02K 7/14 417/367
7,393,188 B2 7/2008 Lawyer et al.
7,744,355 B2 * 6/2010 Costa ..... F04B 17/03 417/423.3
7,880,348 B2 * 2/2011 McElveen ..... H02K 5/18 310/64
8,197,232 B2 6/2012 Lawyer
8,214,937 B2 7/2012 Lawyer
8,359,831 B2 1/2013 Chmielewski et al.
8,708,672 B2 * 4/2014 Marks ..... A61H 33/60 417/420
10,519,956 B2 12/2019 Lawyer
2001/0016170 A1 8/2001 Ozaki
2004/0018104 A1 * 1/2004 Watkins ..... A01K 63/047 417/423.3
2004/0218468 A1 11/2004 Terentiev
2005/0045161 A1 * 3/2005 Ohhashi ..... F02M 25/0818 123/519
2005/0076851 A1 4/2005 Allis
2005/0120473 A1 6/2005 Southon
2006/0013714 A1 1/2006 Wu
2006/0210412 A1 9/2006 Lawyer et al.
2009/0064406 A1 * 3/2009 Lawyer ..... A61H 33/0091 4/541.1
2010/0107615 A1 5/2010 Chmielewski et al.
2012/0045352 A1 2/2012 Lawyer

* cited by examiner

PUMP AND PUMP ASSEMBLY

CROSS-REFERENCE TO RELATED APPLICATIONS

This application is a continuation U.S. application Ser. No. 15/359,792, filed Nov. 23, 2016, now U.S. Pat. No. 10,519,956, which is a continuation of U.S. application Ser. No. 13/215,675, filed Aug. 23, 2011, which claims the benefit of priority of U.S. Provisional Application No. 61/375,961, filed Aug. 23, 2010, the disclosures of which are herein incorporated by reference and to which priority is claimed.

FIELD OF THE INVENTION

The present invention relates to fluid pump assemblies, including magnetically coupled liquid pump assemblies useful with aquariums, terrariums, foot spa basins and the like.

BACKGROUND

Pumps come in various designs depending on their operating requirements and the environment in which they will be used. One type of pump assembly that has been developed utilizes two separate housings which are operably connected to each other by magnets. One housing contains a drive motor and is designed to be placed outside of a container. A second housing is placed inside of the container and is held in place through a magnetic connection with the first housing. The drive motor rotates a magnet located in the first housing. The magnet of the first housing is magnetically coupled to a magnet in the second housing so that the magnet in the second housing rotates with the magnet in the first housing. The magnet in the second housing is connected to a propeller or an impeller to impart movement to fluid in the container.

Magnetically coupled pumps have mainly been used in aquariums and provide a number of advantages over prior devices. Magnetically coupled pumps may be placed in any location on a container without concern over a mechanical mount. The attraction force of the magnets through the container wall holds the pump in place, eliminating the need to place holes in the container. The elimination of brackets or other mechanical fasteners reduces the amount of used materials and the overall weight of the pump. Mechanical fasteners may fracture or break, resulting in an otherwise operable pump becoming inoperable or less efficient because it cannot be held in a proper position. A magnetically coupled pump also eliminates the need for electrical components to be submerged in water, eliminating the need to seal the motor housing, resulting in a smaller and lighter pump.

SUMMARY

In an exemplary embodiment the invention is directed to a pump. The pump includes a housing, a casing disposed in the housing, and a drive motor disposed in the casing. A magnet is operatively associated with the drive motor to rotate when the drive motor is in operation. A fan is operatively associated with the magnet to rotate when the magnet rotates.

In another exemplary embodiment the invention is directed to a pump having a housing, a drive motor, and a magnet. The housing includes at least one air inlet vent and at least one air outlet vent. The drive motor is disposed in the housing and a magnet is operatively associated with the drive motor. A fan is connected to the magnet to draw air through the housing.

In a further exemplary embodiment the invention is directed to a pump assembly having a first housing and a second housing. A casing is disposed in the first housing and a drive motor is disposed in the casing. A first magnet is disposed in the first housing and operatively associated with the drive motor. A fan is connected to the first magnet. The second housing contains a second magnet and a blade is operatively connected to the second magnet for imparting movement to a fluid. The first housing and the second housing are capable of being magnetically coupled to one another through the first and second magnets.

DETAILED DESCRIPTION OF EXEMPLARY EMBODIMENT(S) AND EXEMPLARY METHOD(S)

Figure 1:
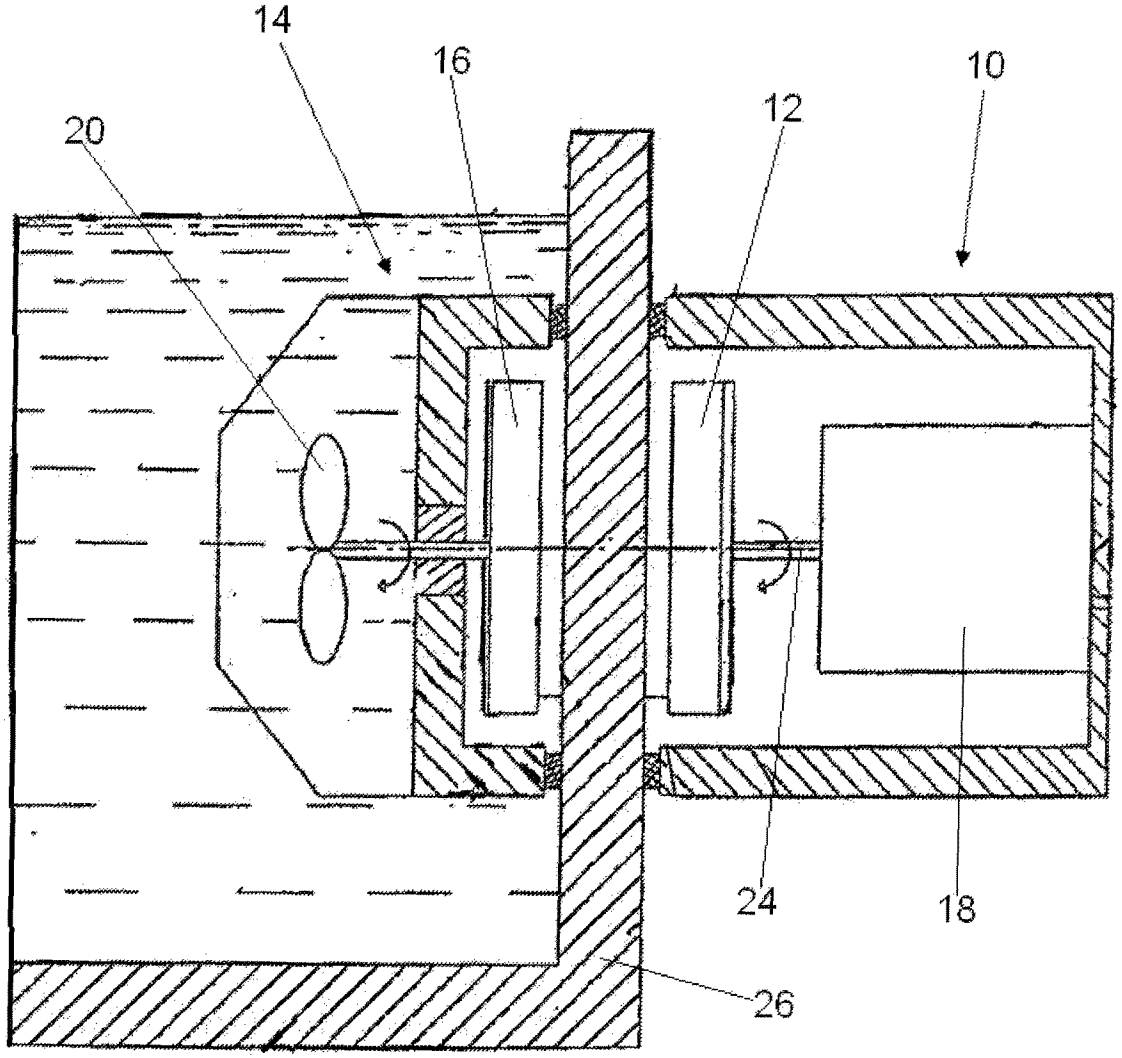
FIG. 1 is a sectional, schematic view of an exemplary pump assembly.

Reference will now be made in detail to exemplary embodiments and methods of the invention as illustrated in the accompanying drawings, in which like reference characters designate like or corresponding parts throughout the drawings. It should be noted, however, that the invention in its broader aspects is not limited to the specific details, representative devices and methods, and illustrative examples shown and described in connection with the exemplary embodiments and methods.

As best shown in FIG. 1, a fluid pump assembly comprises a dry-side assembly 10 containing at least one magnet 12 and a wet-side assembly 14 containing at least one magnet 16. The wet-side magnet 16 is operatively associated with a blade 20 for imparting movement to a fluid. The dry-side magnet 12 is connected to a shaft 24 which is driven by a motor 18 to rotate about an axis. In an exemplary embodiment, the dry-side magnet 12 is a circular disc having at least one pair of magnetic poles N and S. The poles may be arranged in an equal and opposite fashion, and can be arrayed in a radial pattern around the disc. The dry-side magnet 12 may be made from a variety of magnetic materials. In an exemplary embodiment, the dry-side magnet 12 is made from neodymium or other high performance magnetic material.

The drive motor 18 may be of any appropriate type, such as electric, hydraulic, pneumatic, etc. In an exemplary embodiment, the drive motor 18 is an electric motor operating on either AC or DC. The motor 18 is connected to a power source (not shown) which may be a battery or outlet power. The drive shaft 24 rotates the dry-side magnet 12 about an axis. Because the movement of the dry-side magnet 12 creates a magnetic field, it may be useful to shield the motor 18 with a cover made out of a material, such as steel, that will prevent the magnetic field generated by the magnet from affecting the motor 18.

The dry-side assembly 10 may be permanently or releasable secured to the wall of a container 26. Alternatively, the dry-side assembly 10 and the wet-side assembly 14 are placed on opposite sides of the container 26 and hold each other in place through the magnetic interaction between the magnets 12, 16. When the pump is activated, the drive motor 18 will rotate the dry-side magnet 12. Rotation of the dry-side magnet 12 causes rotation of the wet-side magnet 16, which causes the blade 20 to rotate and imparts movement to the fluid in the container 26.

The magnetic attraction between the magnets 12, 16 should be sufficiently high so that the wet-side assembly 14 is held in place in the container 26 with enough force to prevent it from being dislodged due to liquid circulation or slight contact. For example, the net magnetic attraction between the dry-side assembly 10 and the wet-side assembly 14 may be at least 1.0 pound, though the net magnetic attraction may be varied depending on the size of the pump and the operating environment. Additionally, a variety of friction elements or cooperating projections and depressions between the assemblies 10, 14 and the container 26 may be included. Though not necessary, additional brackets or other mechanical holding means can be included to attach the assemblies 10, 14 to the container 26.

Figure 2:
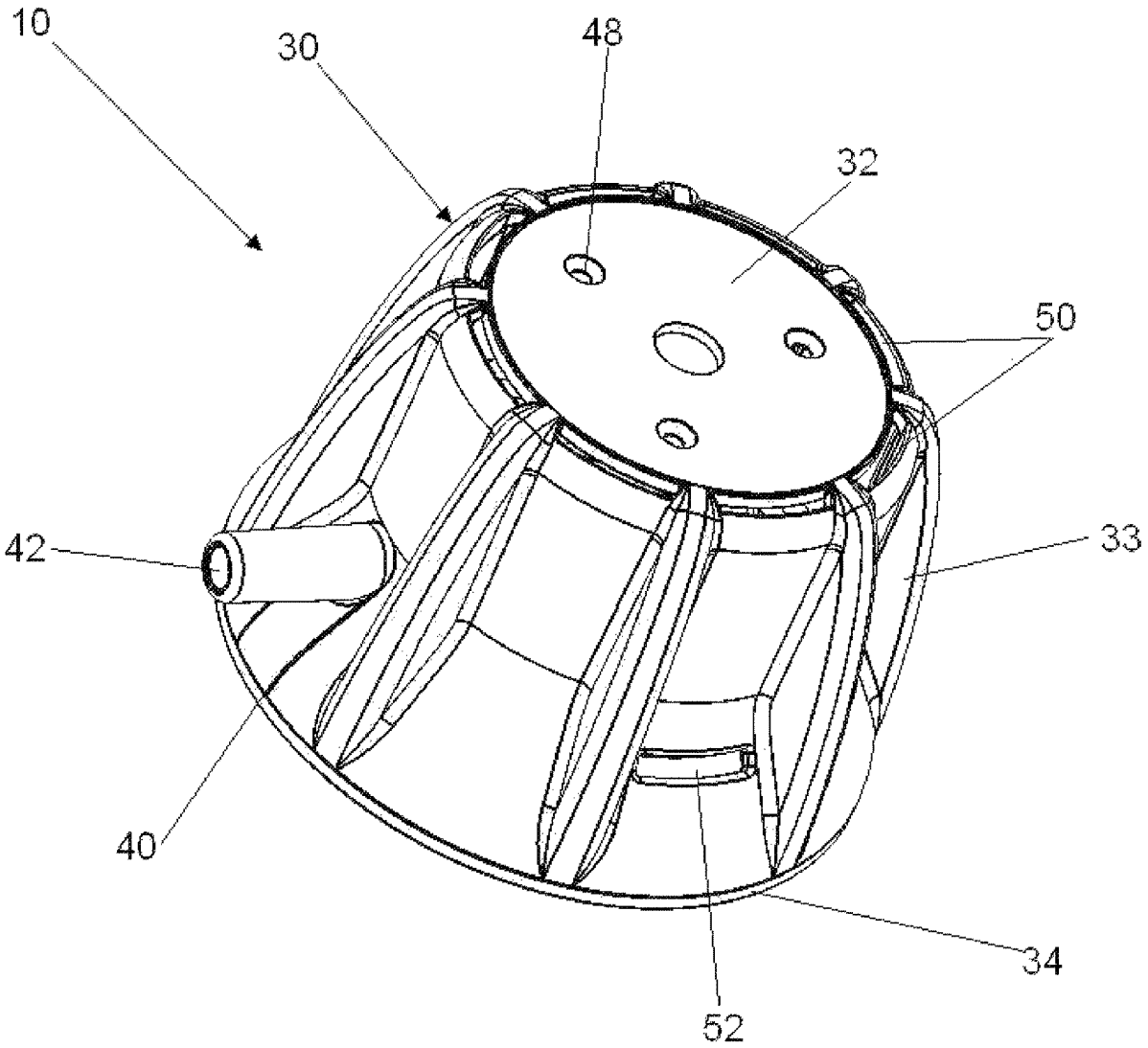
FIG. 2 is a perspective view of an exemplary motor casing.
Figure 3:
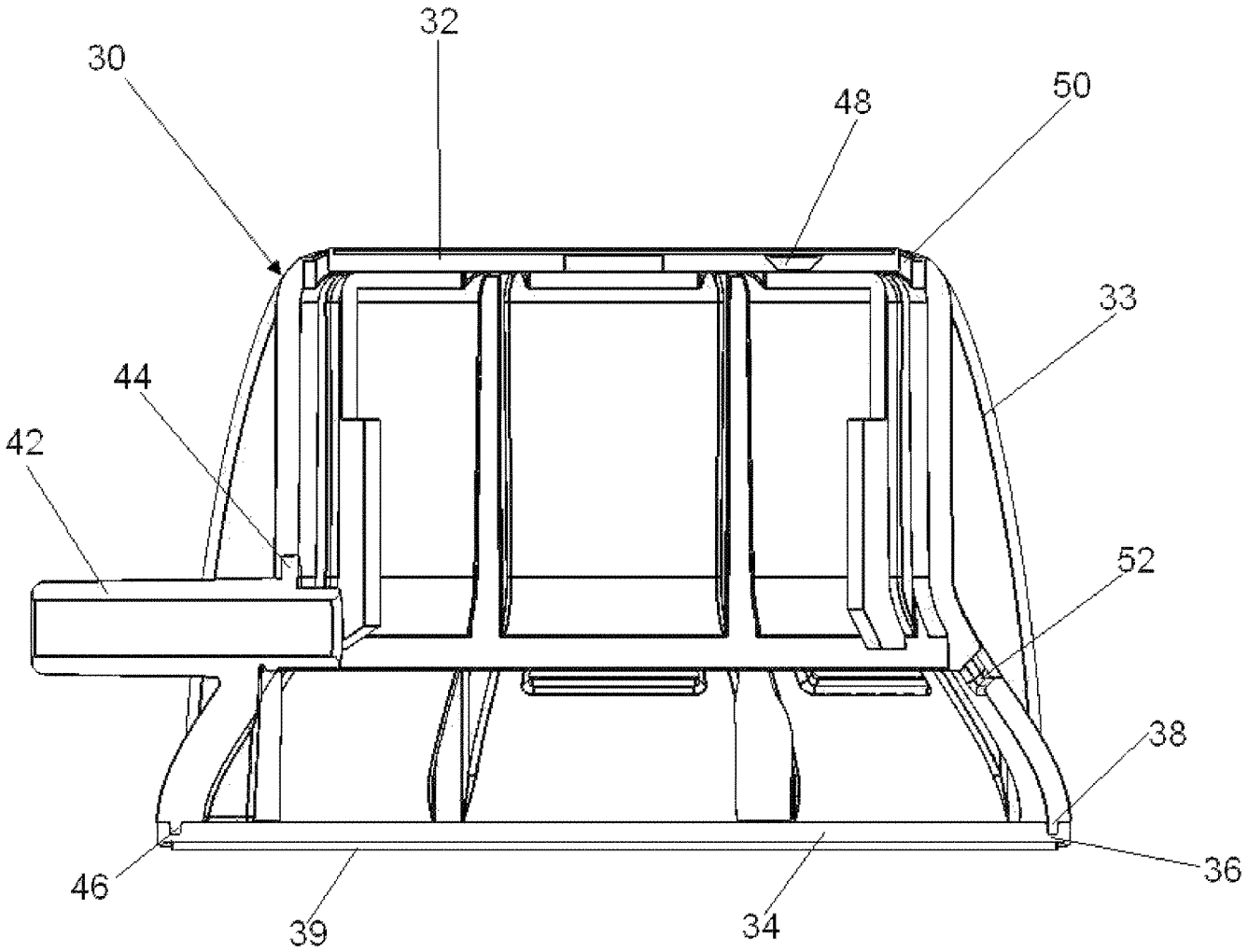
FIG. 3 is a plan, sectional view of the motor casing of FIG. 2.

An exemplary embodiment of the dry-side assembly 10 will now be explained in more detail. As best shown in FIGS. 2 and 3, the dry side assembly 10 comprises a housing 30. The housing 30 includes a top portion 32, a plurality of side ribs 33, and an open bottom for receiving a bottom cover 34. The housing 30 may be made from a material having a low thermal conductivity, such as a polymer material, and may be formed via a molding or extruding process. The side ribs 33 may vary in number and spacing. The side ribs 33 add strength to the housing 30 and assist in handling and placement of the housing 30 on a container 26.

In an exemplary embodiment, the bottom cover 34 is releasably secured to the remainder of the housing 30. As best shown in FIG. 3, the bottom cover 34 has a channel 36 which receives a projection 38 formed in the bottom of the housing 30. The projection 38 may interlock with the channel 36, or an adhesive may be applied to connect the two more permanently. Additional tabs or protrusion may be used in connection with or in place of the projection 38 to attach the bottom cover 34 to the housing 30. A pad 39 made from a resilient material such foam, rubber, or silicone may be attached to the bottom of the cover 34. The pad 39 separates the bottom cover 34 from a wall of the container 26, acting as a cushion to prevent damage to both the dry-side assembly 10 and the container 26. The pad 39 may also act as a friction device which assists in preventing the dry-side assembly 10 from rotating relative to the container 26 and to the wet-side assembly 14 during operation of the pump. An adhesive layer, for example a releasable adhesive, may be attached to the outer side of the pad 39 to increase the security of the connection between the housing 30 and the container 26.

In an exemplary embodiment, the housing 30 has a slot 40 which can receive a grommet 42. The grommet 42 is made from a flexible material, for example rubber, to provide a flexible connection for a power cable (not shown) that connects to the motor 18 through the housing 30. The grommet 42 prevents the cable from becoming worn due to contact with the housing 30. The grommet 42 may attach to the housing through a mechanical connection, an adhesive connection, or a combination of both. As shown in FIG. 3, an exemplary embodiment of the grommet 42 has a first tab 44 and a second tab 46 for connecting with the housing 30 and the bottom cover 34 respectively. The housing 30 may also be provided with a slot to retain the grommet 42. If a power source is used for the motor 18 that does not require a direct cable connection, such as battery power, the grommet 42 and thus the slot 40 may not be incorporated into the housing 30.

The top portion 32 of the housing 30 may have a plurality of holes 48 for receiving screws, bolts, or other mechanical fasteners to connect the housing 30 to the motor 18. Holes 48 may be chamfered to provide countersinking, allowing the mechanical fasteners to be either flush with or below the outer surface of the top portion 32. The top portion 32 may also have a plurality of upper vents 50. The upper vents 50 assist in providing air flow through the housing. For example, the upper vents 50 may act as air inlet vents. The housing 30 may also include a set of lower vents 52 spaced from the upper vents 50. The lower vents 52 may act as air outlet vents in conjunction with air received from the upper vents 50. The number of vents 50, 52, as well as their size and shape, may vary to allow for optimized air flow through the housing 30 and around the motor 18. For example, areas of the housing 30, 32 around the vents 50, 52 may have transition portions, such as the rounded edges shown around the upper vents 50 or the tapered portions shown around the lower vents 52. The transition portions reduce turbulence which can lessen noise and increase heat transfer efficiency.

Figure 4:
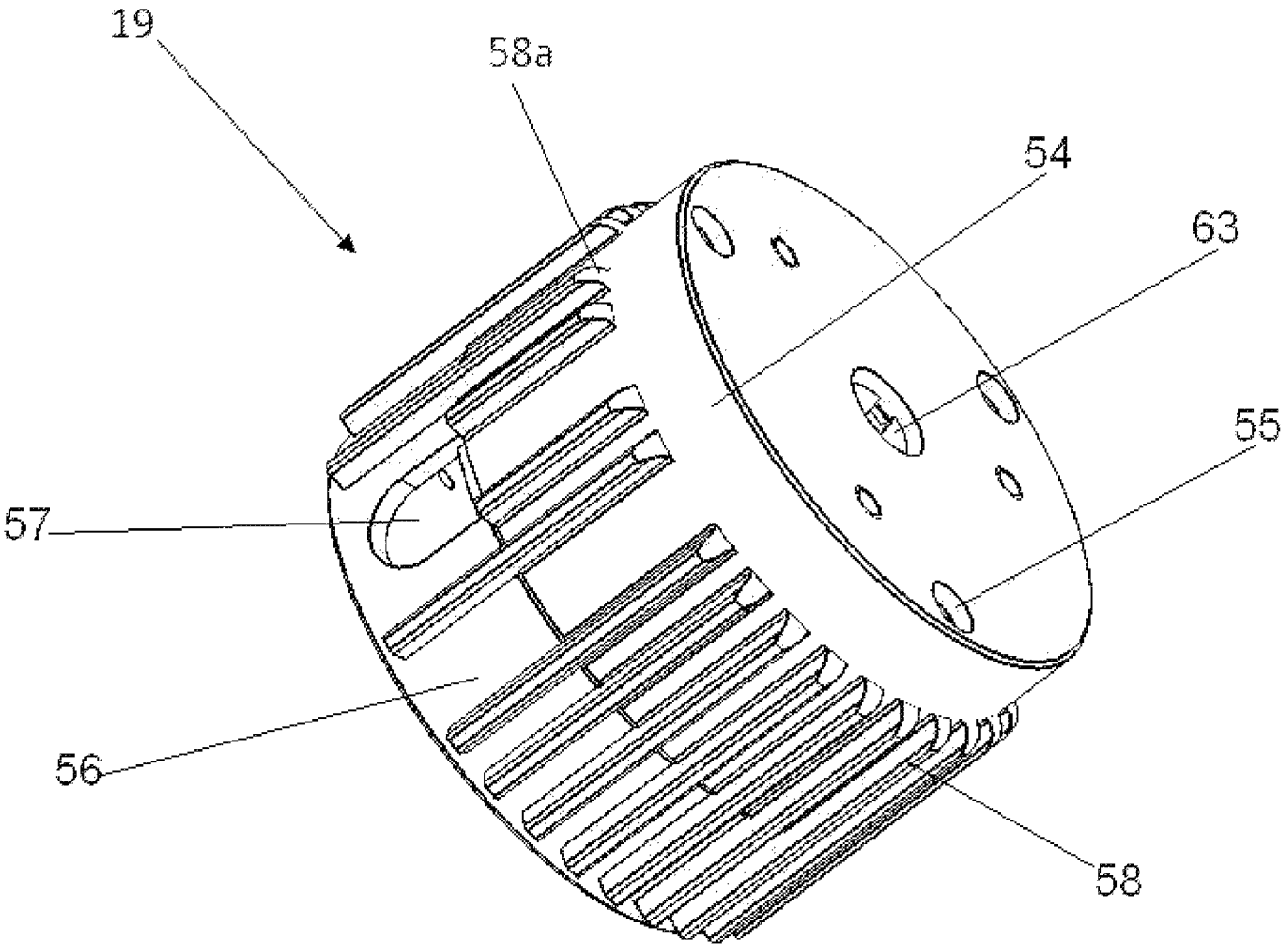
FIG. 4 is a perspective view of an exemplary motor casing.

In an exemplary embodiment, the motor 18 is surrounded by an exterior casing 19. As best shown in FIG. 4, the casing 19 may include a top endcap 54 and a bottom endcap 56. The endcaps 54, 56 may be formed from a variety of materials. In an exemplary embodiment, the endcaps 54, 56 are formed from a material having a high thermal conductivity such as aluminum. While the endcaps 54, 56 are shown and described herein as separate pieces, it is possible that the endcaps 54, 56 are formed as a unitary structure. The top endcap 54 may have a plurality of holes 55 to accommodate screws, bolts, or other mechanical fasteners to connect the top endcap 54 to the housing 30. As shown in FIG. 4, these holes 55 may be chamfered to provide countersinking, similar to holes 48 in the housing 30.

In an exemplary embodiment, the motor casing 19 has at least one fin 58. Preferably, a plurality of fins 58 are arrayed circumferentially around the endcaps 54, 56 as shown in FIG. 4. The fins 58 extend longitudinally along the exterior surface of the motor casing 19. These fins 58 may be connected to, or formed integrally with, either the top endcap 54 or to the bottom endcap 56. The fins 58 may be formed from the same material as the endcaps 54, 56 or from a separate material. Because the fins 58 act as heat exchangers, they may be formed from a material having a higher thermal conductivity than the endcaps 54, 56. In an exemplary embodiment, the fins 58 will be connected to the top endcap 54 and extend down below the top endcap 54 so that they are at least partially covering the bottom endcap 56. The diameter of the endcaps 54, 56 or the fins 58 may be dimensioned so that the fins 58 extending from the top endcap 54 contact the bottom endcap 56.

Figure 5:
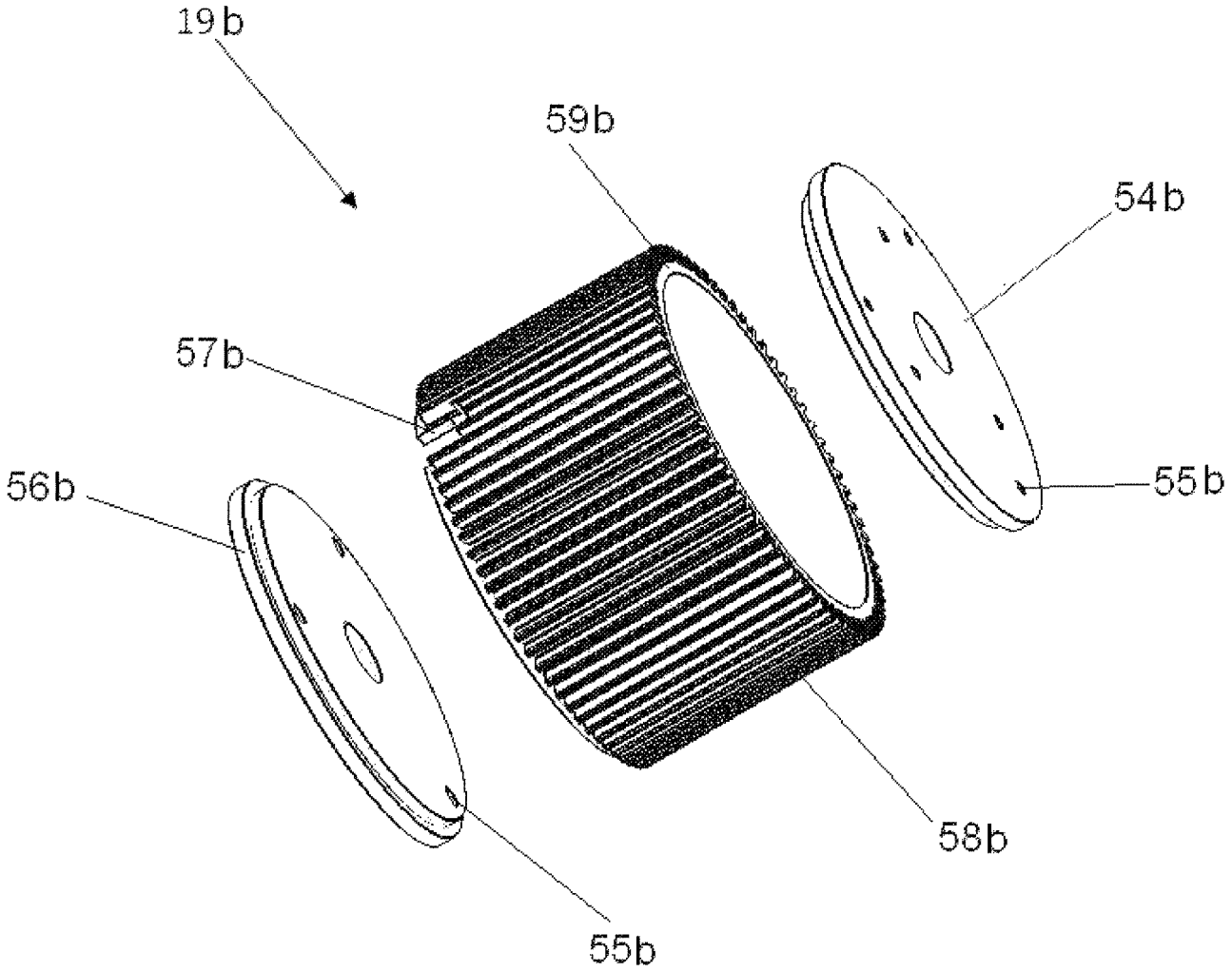
FIG. 5 is an exploded, perspective view of an exemplary motor casing.

The fins 58 may be substantially frusto-pyramidal in shape, so that the bottom portion of the fin 58 connected to the casing 19 is longer than the top portion and the sides taper upwards towards each other. As best shown in FIG. 4, the side of the fins 58 may have a rounded surface 58*a*. This rounded side surface 58*a* will face the air inlet vents 50 of the motor housing 30. As air is drawn in through the inlet vents 50, it flows over these rounded surfaces 58*a* before encountering the rest of the fin 58. This helps maintain a smoother, more laminar flow, increasing the heat transfer along the fins 58 and resulting in quieter operation of the pump. Additionally, the top of the fins 58 may have chamfered, beveled, or rounded edges along the length of the fin to reduce turbulence. In an exemplary embodiment, the fins 58 are as thin as allowed by the associated material to increase the rate of heat transfer. The fins 58 may have an equal length or they may vary in length. As best shown in FIGS. 4 and 5, this may be necessary when a slot 57 is placed in the bottom endcap 56 to allow a portion of the grommet 42 to pass through the endcap 54.

In an exemplary embodiment, the casing 19 is attached to the top portion 32 of the housing 30, for example with mechanical fasteners connected through holes 55. The upper vents 50 are sized to create an opening from approximately the outer surface of the casing 19 to approximately just beyond the fins 58 extended from the outer surface of the casing 19. This allows for air to pass along the fins 58 and the outer surface of the casing 19, increasing the amount of heat transfer.

In the exemplary embodiment shown in FIG. 5, the motor casing 19*b* has a top endcap 54*b*, a bottom endcap 56*b*, and a center casing 59*b*. The top and bottom endcaps 54*b*, 56*b* may have a plurality of holes 55*b* for connecting the housing 30. The holes 55*b* in at least one of the endcaps 54*b*, 56*b* may also be used to connect the endcap to the stator 64 of the motor. The center casing 59*b* includes the slot 57*b* and the fins 58*b* which may be attached to the center casing 59*b* or formed integrally therewith. The fins 58*b* may be evenly distributed and extend along the length of the center casing 59*b*. The endcaps 54*b*, 56*b* and center casing 59*b* may be connected by screws, other mechanical fasteners, or an adhesive. Additionally, a sealing member such as an o-ring may be used to seal the connection between the endcaps 54*b*, 56*b* and the center casing 59*b*.

Figure 6:
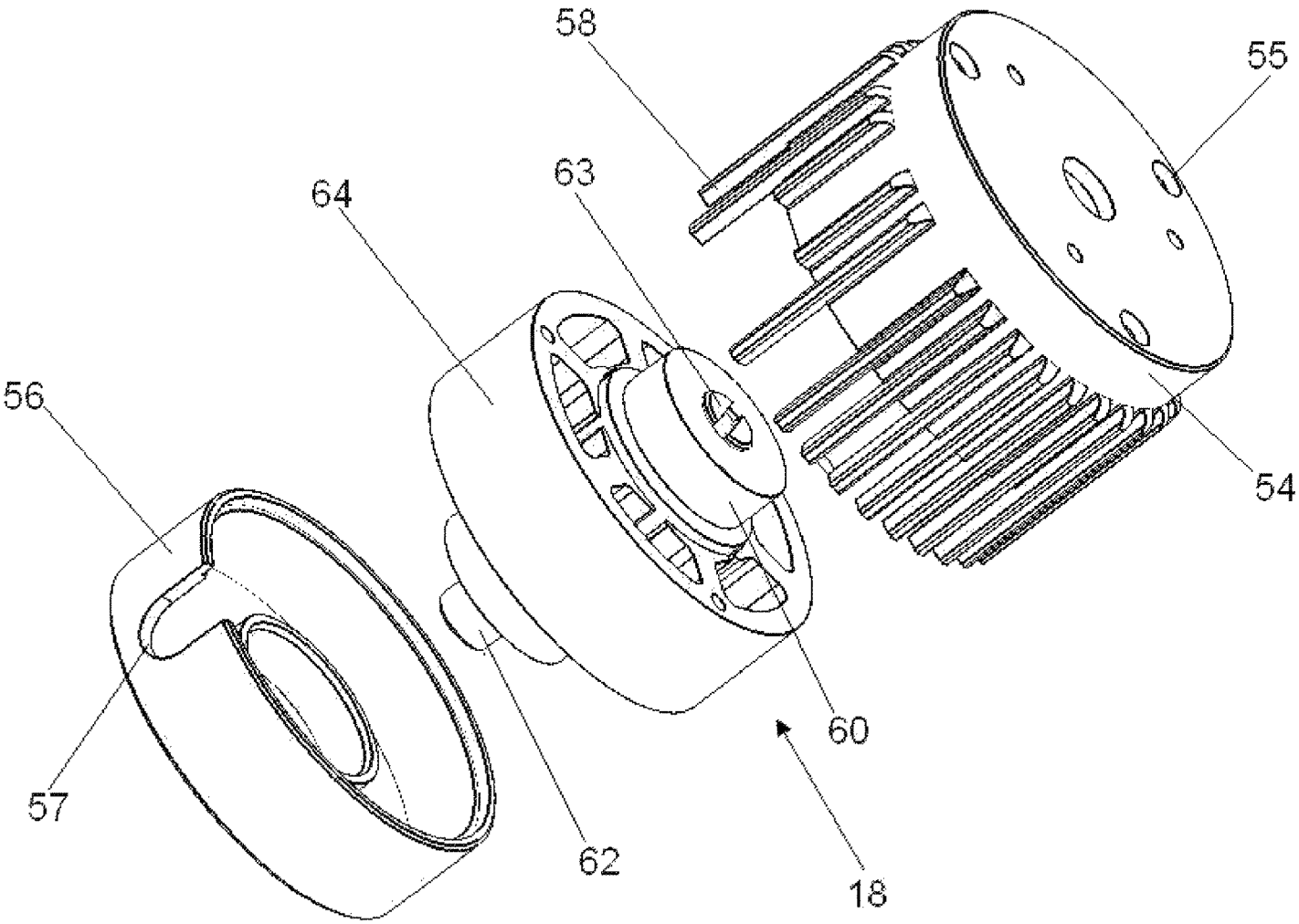
FIG. 6 is an exploded, perspective view of an exemplary motor and motor casing.
Figure 9:
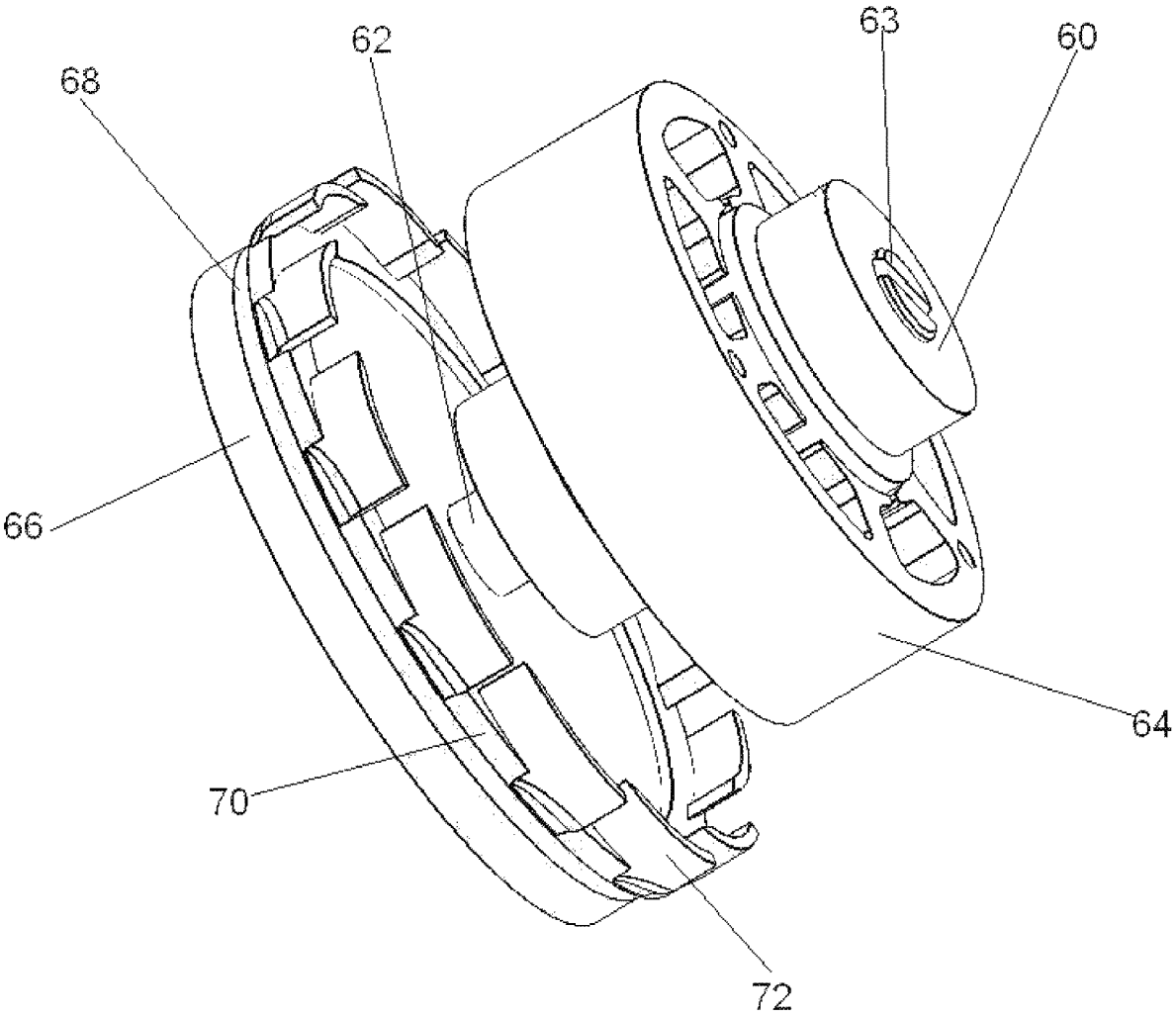
FIG. 9 is a perspective view of an exemplary magnet assembly connected to a motor shaft.

The motor casing 19 houses the internal components of the motor 18. In an exemplary embodiment, the motor 18 is a brushless dc motor, though a variety of motors may be used. FIG. 6 depicts portions of an exemplary motor 18 for reference, while other components have been omitted for clarity as the typical components and operation of a motor 18 will be understood by one of ordinary skill in the art. The motor 18 includes a rotor 60 having a shaft 62, and a stator 64. The bottom of the shaft 62 connects to the dry-side magnet assembly 12. This connection may be achieved in a variety of different ways including bonding and press fit. In an exemplary embodiment, the shaft 62 is connected to the magnet 66 via a threaded connection. The threads on the shaft 62 may be either male or female. When the shaft has a male thread, female threads may be present on the magnet 66 and other components that may be connected therewith, such as plate 68 and a fan 70. In various exemplary embodiments, the magnet 66 has a thread connection while the plate 68 and/or fan 70 are connected to the magnet 66 or one another via and adhesive. Additionally, both the shaft 62 and the magnet 66 may have a female thread, and a threaded fastener may be used to connect the components. As shown in FIG. 9, the top of the shaft 62 may have a slot 63 so that a tool, such as a screwdriver, can be used to drive the shaft 63, screwing it into the magnet assembly 12. Though a flat-head screwdriver slot 63 is shown, a variety of other typical heads may be used such as a phillips heads or a hexagon or allen head. The threaded connection allows for easy assembly and changing of parts.

Figure 7:
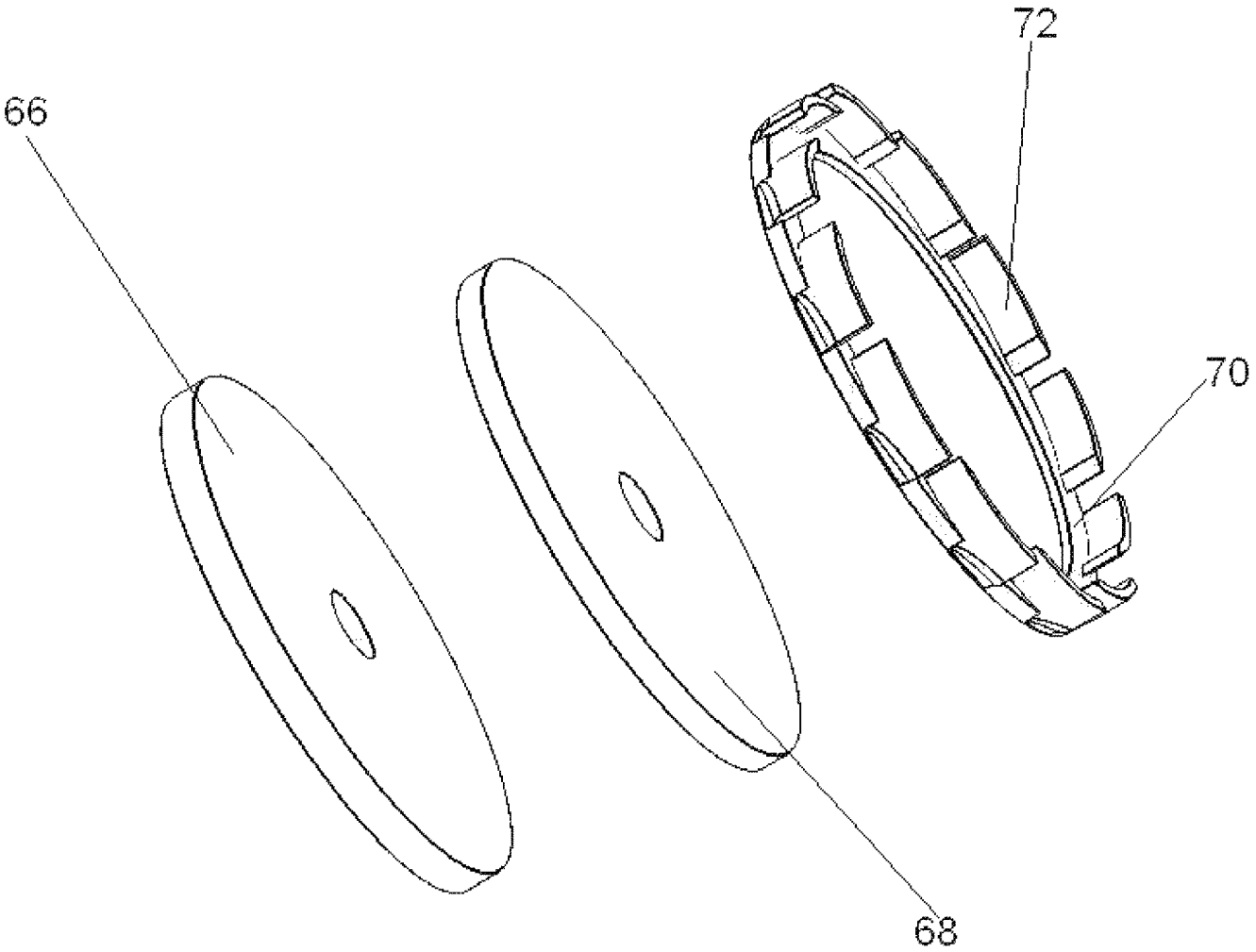
FIG. 7 is an exploded perspective view of an exemplary magnet assembly.
Figure 10:
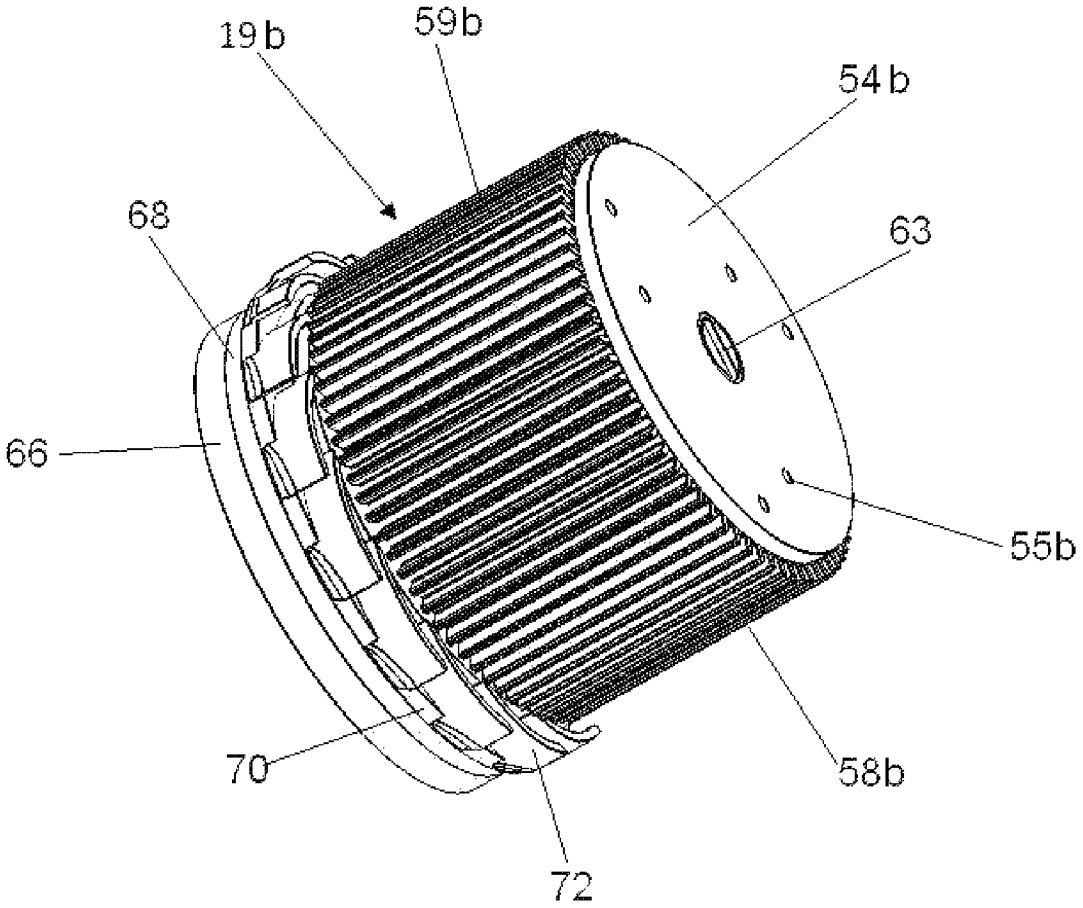
FIG. 10 is a perspective view of an exemplary magnet assembly and motor casing.

As best shown in FIGS. 7, 9, and 10 the magnet assembly 12 comprises a magnet 66, a plate 68, and a fan 70. The magnet 66 may be made from any magnet material, for example neodymium. In an exemplary embodiment, the intermediate plate 68 separates the fan 70 from the magnet 66. The plate 68 may be made of a material, such as steel, that will block magnetic flux from the motor 18. As the dry-side magnet 12 rotates and drives the wet-side magnet 16, a magnetic field is created. Flux from the magnetic field can disturb the operation of the motor 18. The intermediate plate 68 prevents or minimizes this disturbance. The magnet 66, plate 68, and fan 70 may be connected through a variety of different ways, such as mechanical fasteners or adhesives. As discussed above, these components may also be connected to each other through their connection to the shaft 62.

As best shown in FIGS. 7-9, the fan 70 comprises a plurality of blades 72. In an exemplary embodiment, the fan 70 will be designed as an impeller which draws air through the motor casing 30. The fan 70 can be a radial fan or an axial fan. In a radial fan, the air will flow in a radial direction to the shaft, while in an axial fan the air will flow parallel to the shaft. Mixed flow fans, which result in both radial and axial type flow, and cross-flow fans may also be utilized. The fan 70 may be designed so that the airflow through the housing 30 has a near or completely laminar flow. Where laminar flow of the air through the housing is desired, an axial type fan may be used.

Figure 8A:
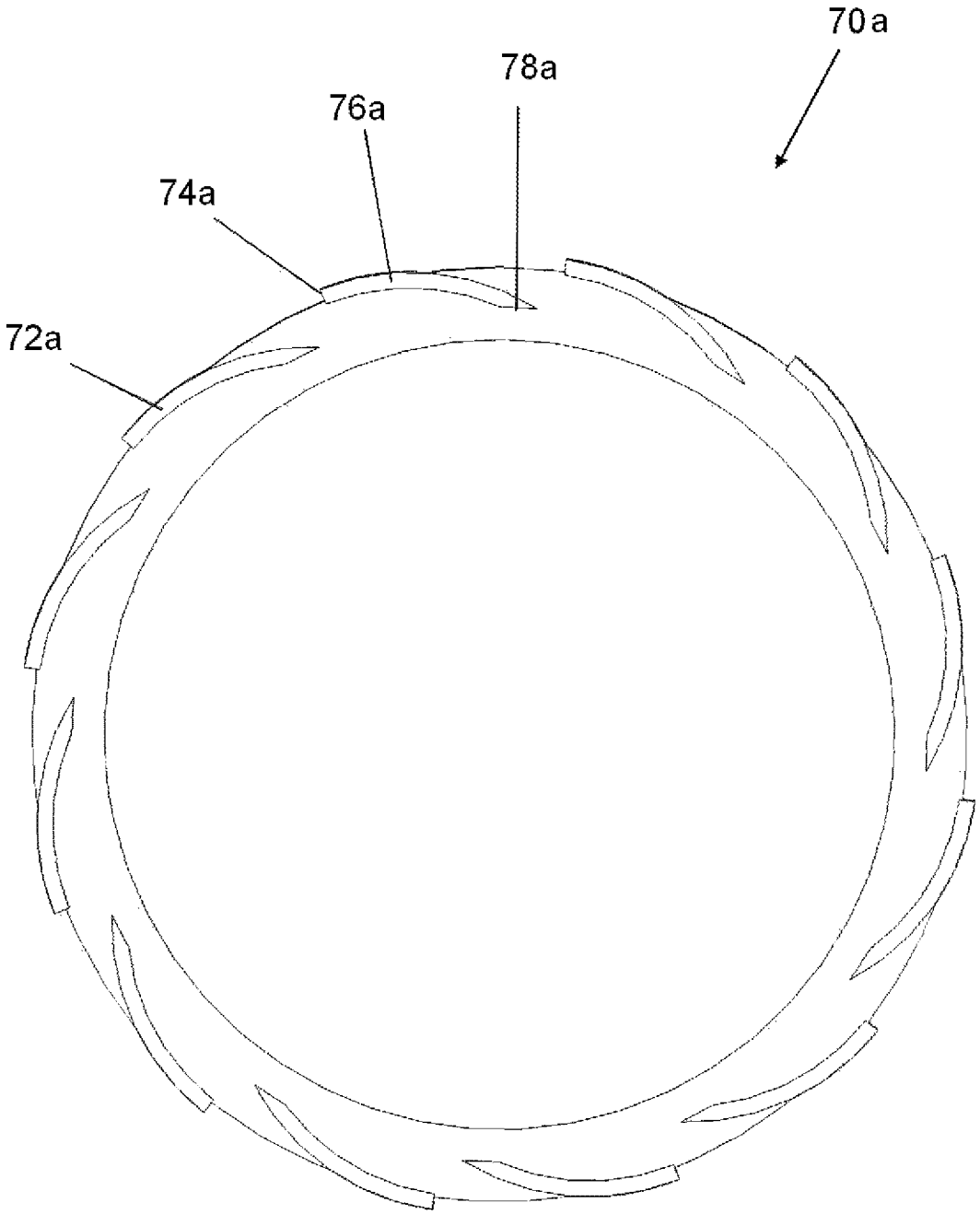
FIG. 8A is a plan view of an exemplary fan.
Figure 8B:
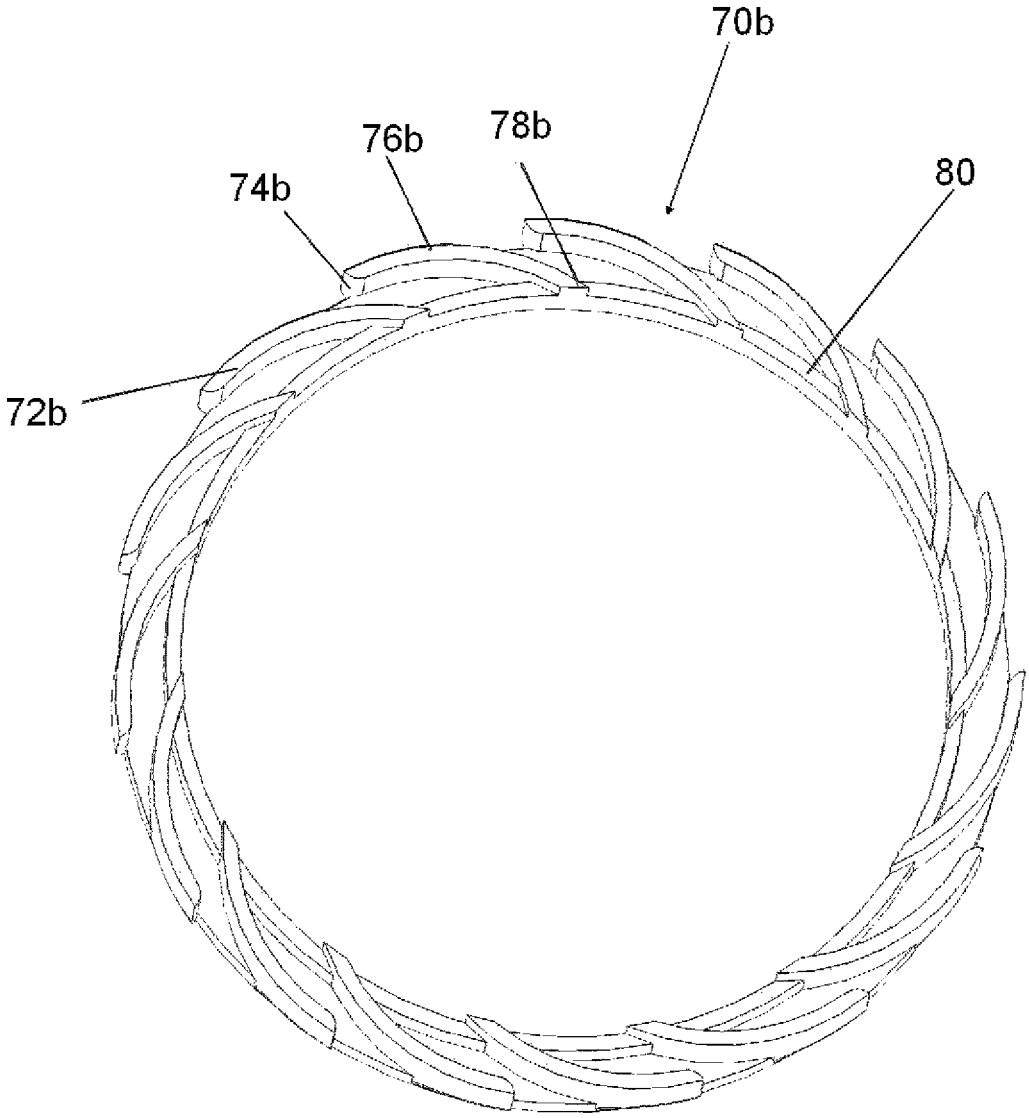
FIG. 8B is a plan view of an exemplary fan.

In the exemplary embodiment shown in FIG. 8A, the blades 72*a* are equally spaced about the fan 70*a*. The blades 72*a* have a flat end 74*a*, a curved body 76*a*, and a tapered end 78*a*. Additionally the fan blades 72*a* are spaced so that they do not overlap one another. Another exemplary embodiment of a fan 70*b* is shown in FIG. 8B. The blades 72*b* have a rounded end 74*b*, a curved body 76*b*, and a tapered end 78*b*. The blades 72*b* are positioned so they overlap one another and extend from the outer edge of the fan 70*b* to the inner edge. The fan 70*b* shown in FIG. 8B also includes a raised inner edge 80*b*. The number, size, shape, and spacing of the blades 72*a*, 72*b* can be varied from the exemplary embodiments shown to optimize airflow through a housing 30, based on the design and internal components thereof.

Figure 11:
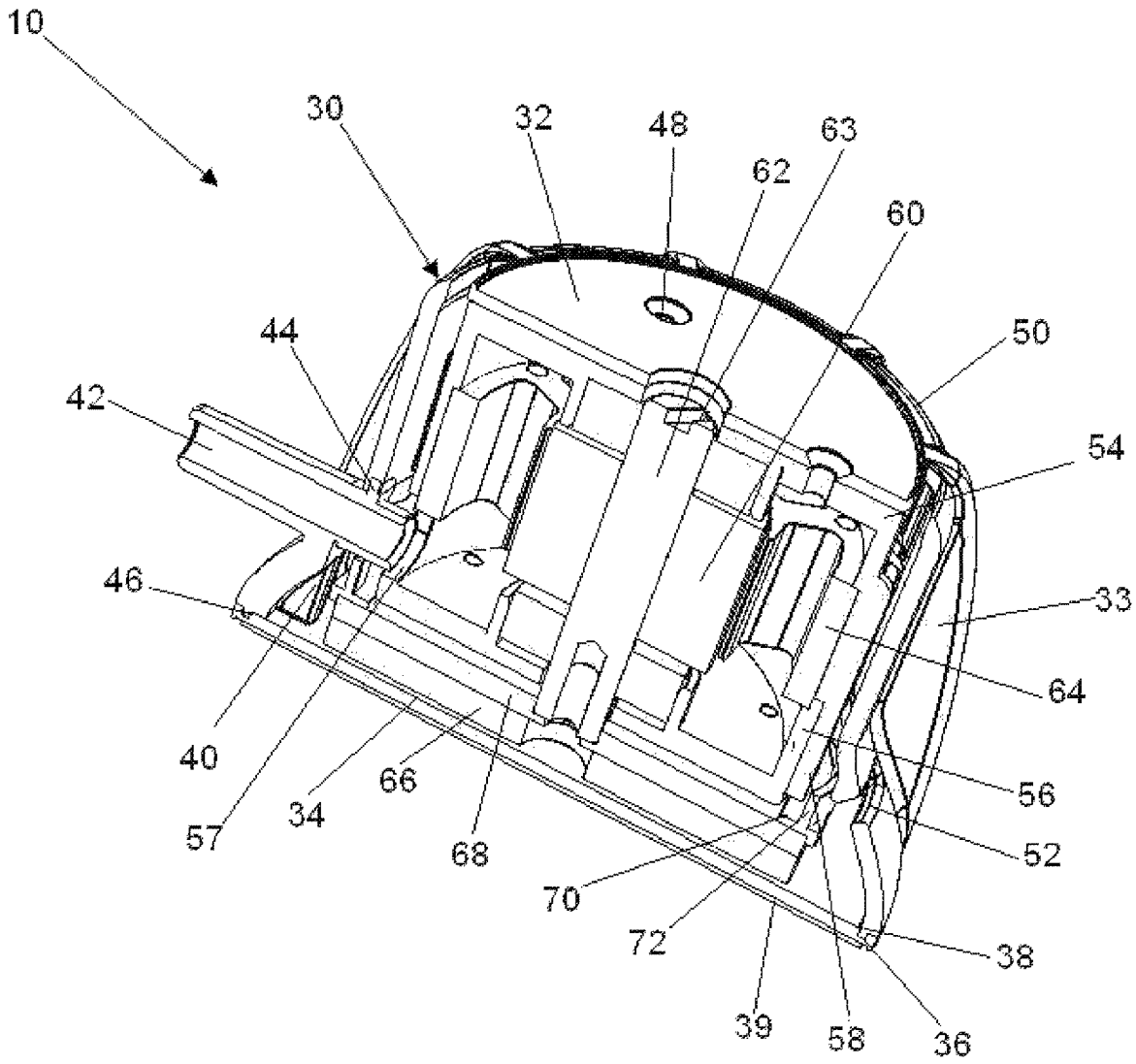
FIG. 11 is a fragmentary cross-sectional view of an exemplary dry side housing.

FIGS. 10 and 11 show an exemplary dry-side assembly 10. The housing 30 is connected to the bottom cover 34 and surrounds the motor 18 and motor casing 19. The pad 39 is connected to the bottom cover 34. The top portion 32 of the housing 30 connects to the top endcap 54 of the motor casing 19. The shaft 62 of the rotor 60 is connected to the magnet 66. As the motor is operated, the shaft 62 will turn, rotating the magnet 66 and the fan 70. The rotating blades 72 of the fan 70 will draw air in through the upper vents 50. The air passes over the motor casing and along the fins 58 (if present). The air then exits the lower vents 52. In this way, air can be drawn through the housing 30 to cool the motor 18. The vents 50, 52 should be designed to allow the most airflow while minimizing noise and turbulence. In an exemplary embodiment, the airflow through the housing 30 is completely laminar.

The fins 58 increase the surface area, and hence the amount of heat transfer between the circulating air and the motor 18, allowing the pump to operate at a higher rate of performance with less of a chance of overheating. Additionally, air cooling the motor 18 can reduce the amount of heat transferred to the container 26. As discussed above, the housing 30 may be made from a material with a low thermal conductivity. Thus, as the air passes through the housing 30, it forms a thermal boundary, minimizing the heat transferred to the housing 30. This may keep the housing 30 cool to the touch, so that it may be safely handled by a user, even after prolonged periods of use.

The foregoing description of the exemplary embodiments of the present invention has been presented for the purpose of illustration. It is not intended to be exhaustive or to limit the invention to the precise forms disclosed. Obvious modifications or variations are possible in light of the above teachings. The embodiments disclosed hereinabove were chosen in order to best illustrate the principles of the present invention and its practical application to thereby enable those of ordinary skill in the art to best utilize the invention in various embodiments and with various modifications as are suited to the particular use contemplated, as long as the principles described herein are followed. Thus, changes can be made in the above-described invention without departing from the intent and scope thereof. Moreover, features or components of one embodiment may be provided in another embodiment. Thus, the present invention is intended to cover all such modification and variations.

What is claimed:

1. An aquarium pump, comprising:

a cylindrical housing having a top portion, an open bottom, a side portion extending between the top portion and the open bottom, at least one air inlet vent, and at least one air outlet vent;

a casing disposed in the housing and having an exterior surface, a plurality of cooling fins disposed on the exterior surface, and a top endcap and a bottom endcap enclosing an interior of the casing;

a drive motor disposed in the casing and comprising a rotatable shaft;

a magnet disposed in the housing and operatively associated with the drive motor to rotate when the drive motor is in operation;

a fan operably associated with the magnet to rotate with the magnet and configured to draw air through the at least one air inlet vent, along the plurality of fins, and to be discharged through the at least one air outlet vent; and a bottom cover closing the open bottom of the housing, the fan comprising a ring having a flat surface and a plurality of spaced blades arranged around the ring on the flat surface and extending away from the flat surface in an axial direction relative to the rotatable shaft.

2. The pump of claim 1, wherein the at least one air inlet vent and the at least one air outlet vent are in communication with one another along a path extending within the housing and along the exterior surface of the casing.

3. The pump of claim 1, further comprising a plate connected between the magnet and the fan.

4. The pump of claim 1, wherein the fins are uniformly disposed on the casing.

5. The pump of claim 4, wherein the plurality of fins are arrayed longitudinally along the exterior surface of the casing.

6. The pump of claim 1, wherein the magnet is connected to the rotatable shaft via a threaded fastener.

7. The pump of claim 1, wherein the bottom cover is releasably connected to the housing.

8. An aquarium pump assembly, comprising:

a first polymeric housing comprising a top portion and a bottom cover, the bottom cover releasably secured to the housing;

a casing disposed in the first housing and having a plurality of fins longitudinally extending therealong;

a drive motor disposed in the casing and comprising a rotatable shaft;

a first magnet disposed in the first housing and operatively associated with the drive motor;

a fan connected to the first magnet, the fan comprising a ring having a flat surface and a plurality of spaced blades arranged around the ring on the flat surface and extending away from the flat surface in an axial direction relative to the rotatable shaft; and a second housing containing a second magnet and a blade operatively connected to the second magnet for imparting movement to a fluid, wherein the first housing and the second housing are configured to be magnetically coupled to one another through the first and second magnets.

9. The pump assembly of claim 8, wherein the first housing comprises at least one air inlet vent and at least one air outlet vent.

10. The pump assembly of claim 8, further comprising a plate connected between the first magnet and the fan.

* * * * *